US005615591A

United States Patent [19]

Scherch et al.

[11] Patent Number: 5,615,591

[45] Date of Patent: Apr. 1, 1997

[54] FOOD PRODUCT SLICER HAVING AN INTERLOCK MECHANISM

[75] Inventors: Richard P. Scherch, Johnston, Iowa; Timothy A. Schrand, West Chester, Ohio; James A. Shirk, Union, Ohio; Danny J. Mitchell, Frankling, Ohio

[73] Assignee: Premark FEG Corporation, Wilmington, Del.

[21] Appl. No.: 289,684

[22] Filed: Aug. 12, 1994

[51] Int. Cl.[6] ..... B26D 7/22

[52] U.S. Cl. ..... 83/399; 83/703; 83/707; 83/932

[58] Field of Search ..... 83/730, 168, DIG. 1, 83/703, 707, 399, 932; 403/315, 316

[56] References Cited

U.S. PATENT DOCUMENTS

| | | | |
|---|---|---|---|
| 1,518,474 | 12/1924 | Wile . | |
| 2,402,519 | 6/1946 | Wood | 83/730 |
| 2,573,860 | 11/1951 | Meeker et al. | 146/102 |
| 2,744,554 | 3/1956 | King | 146/102 |
| 2,970,623 | 2/1961 | Lundell | 83/703 |
| 3,159,196 | 12/1964 | Engi | 83/399 |
| 3,704,736 | 12/1972 | Pratley | 83/397 |
| 4,070,941 | 8/1976 | Lorenz | 83/478 |
| 4,217,650 | 8/1980 | Kuchler | 364/567 |
| 4,246,818 | 1/1971 | McGraw, Jr. | 83/545 |
| 4,295,287 | 10/1981 | Natzke | 403/316 |
| 4,379,416 | 4/1983 | Kuchler | 83/23 |
| 4,397,206 | 8/1983 | Czala | 83/730 |
| 4,541,319 | 9/1985 | Mauer et al. | 83/707 |
| 4,598,618 | 7/1986 | Kuchler | 83/77 |
| 4,763,738 | 8/1988 | Kuchler | 177/50 |
| 4,813,316 | 3/1989 | Johnson et al. | 83/42 |
| 5,241,885 | 9/1993 | Kuchler | 83/76.7 |
| 5,245,898 | 9/1993 | Somal et al. | 83/58 |

FOREIGN PATENT DOCUMENTS

| | | | |
|---|---|---|---|
| 0503168 | 12/1991 | European Pat. Off. . | |
| 1196985 | 7/1965 | Germany | 83/DIG. 1 |
| 2749652 | 5/1979 | Germany | 83/DIG. 1 |
| 3201520 | 7/1983 | Germany . | |
| 2090122 | 5/1981 | United Kingdom . | |

*Primary Examiner*—Kenneth E. Peterson
*Attorney, Agent, or Firm*—Thompson Hine & Flory LLP

[57] ABSTRACT

A food product slicing machine includes a coupling and associated interlock mechanism for connecting and disconnecting a carriage arm of the food slicing machine to and from a reciprocating carriage base mounted to the housing of the machine. The coupling includes a cylindrical mounting head which is rotatably mounted in the carriage base by a bracket. The mounting head contains a slot for slidably receiving a foot of the carriage arm, and the bracket also contains a slot with which the mounting head slot can be aligned through rotation of the mounting head within the bracket. The mounting head slot and bracket slot must be aligned in order to attach or remove the carriage arm's foot to or from the carriage base. The interlock mechanism is provided to prohibit the alignment of the slots when the gauge plate of the slicing machine is not in a safe position. Accordingly, the carriage arm may not be removed from the carriage base when the gauge plate is not in the safe position.

6 Claims, 5 Drawing Sheets

FOOD PRODUCT SLICER HAVING AN INTERLOCK MECHANISM

BACKGROUND OF THE INVENTION

The present invention relates to food product slicers and, in particular, to a food product slicer having an interlock device which allows the food carriage tray and supporting arm to be removed only when the gauge plate is closed and prevents opening of the gauge plate when the carriage is removed.

Commercial food product slicers are widely utilized as rapid and effective means of slicing meat, cheese, vegetables and other food products. These machines commonly include a motor driven circular slicing blade having a peripheral cutting edge and a means for passing the food product to be cut over the blade. To adjust the thickness of the slice, these machines include a means for adjusting the distance between the slicing blade and the gauge plate, which distance determines the thickness of the food slice. Because of the nature of these machines, food and fat debris often build up on the gauge plate and carriage. Thus, both the product carriage and the gauge plate must be frequently cleaned.

To facilitate cleaning of the carriage and gauge plate of a conventional food product slicer, slicers have been designed such that the carriage can be removed from the machine or pivoted away from the cutting deck of the machine. Once the carriage is moved away from the body of the slicer, the edge of the cutting blade near the gauge plate is exposed. To prevent the user from coming into contact with the edge of the blade, food product slicers have been designed with an interlock device which allows the user to move the carriage only if the gauge plate has first been closed, i.e., adjusted to a position approximately coplanar with the slicing blade, thus providing coverage of the blade edge.

U.S. Pat. No. 4,541,319 to Maurer, et al. describes an interlock device for a meat slicing machine. The carriage of this meat slicer can only be pivoted away from the machine when the gauge plate is closed. When the carriage is pivoted from the machine, it articulates a slider member. When the gauge plate is open, a stop face of a slider member engages a counter stop member attached to the carriage thereby preventing the carriage from being pivoted.

Other food slicers require that the carriage be at either an extreme front or rear position, relative to the operator, to engage the slicer's interlock device. Thus, a need has developed for an interlock device which allows the operator to remove the food carriage tray and supporting arm without moving the carriage to an extreme end position.

SUMMARY OF THE INVENTION

The present invention is directed to a food product slicer having an interlock mechanism which prevents the carriage from being removed from the slicer unless the gauge plate is closed. The carriage includes a food product carriage tray and a supporting arm which is slidably received in a mounting head. The mounting head pivots about a linkage to a plunging element which is biased inwardly by a spring. Opening and closing of the gauge plate is controlled by an adjustment knob which rotates a cam plate. The cam plate includes a notch or recess on its peripheral edge which receives a pin carried on an interlock bar which extends the length of the carriage path. The interlock bar is rotationally biased by a torsion spring such that the pin on the bar rides along the outer peripheral edge of the cam plate as the cam plate is rotated. To remove the carriage arm from the slicing machine, the gauge plate must be closed, i.e., the gauge plate is coplanar with or slightly raised above the slicing blade when the slice thickness setting is zero. When the gauge plate is closed, the pin on the interlock bar is received in the cam plate notch. The interlock bar is shaped cross-sectionally such that when the pin is in the notch on the cam plate, the plunging element can pass beneath the interlock bar. When the plunging element moves beneath the flat portion, the pin cannot move out of the notch in the cam plate and the mounting head holding the carriage arm can be pivoted to a position at which the arm can be removed from the slicer. With the carriage arm removed from the slicer, an interlock is established which prevents the gauge plate from being opened unless the carriage arm is replaced in the mount head and the head is pivoted. When the plunging element is underneath the interlock bar, the pin is secured into the notch in the cam plate and the adjustment knob for the gauge plate cannot be moved. An inward axial force is exerted on the plunging element by a compression spring which is strong enough that the plunging element cannot be withdrawn by hand. The leverage of the carriage arm is required to retract the plunging element from the interlock position. Because the interlock bar extends the length of the carriage path, the carriage arm can be removed from the slicer at any position along the path of reciprocation of the carriage. On the other hand, when the gauge plate is open, the plunging element cannot pass beneath the interlock bar and the carriage arm cannot be removed from the mounting head.

DETAILED DESCRIPTION OF THE INVENTION

Figure 1:
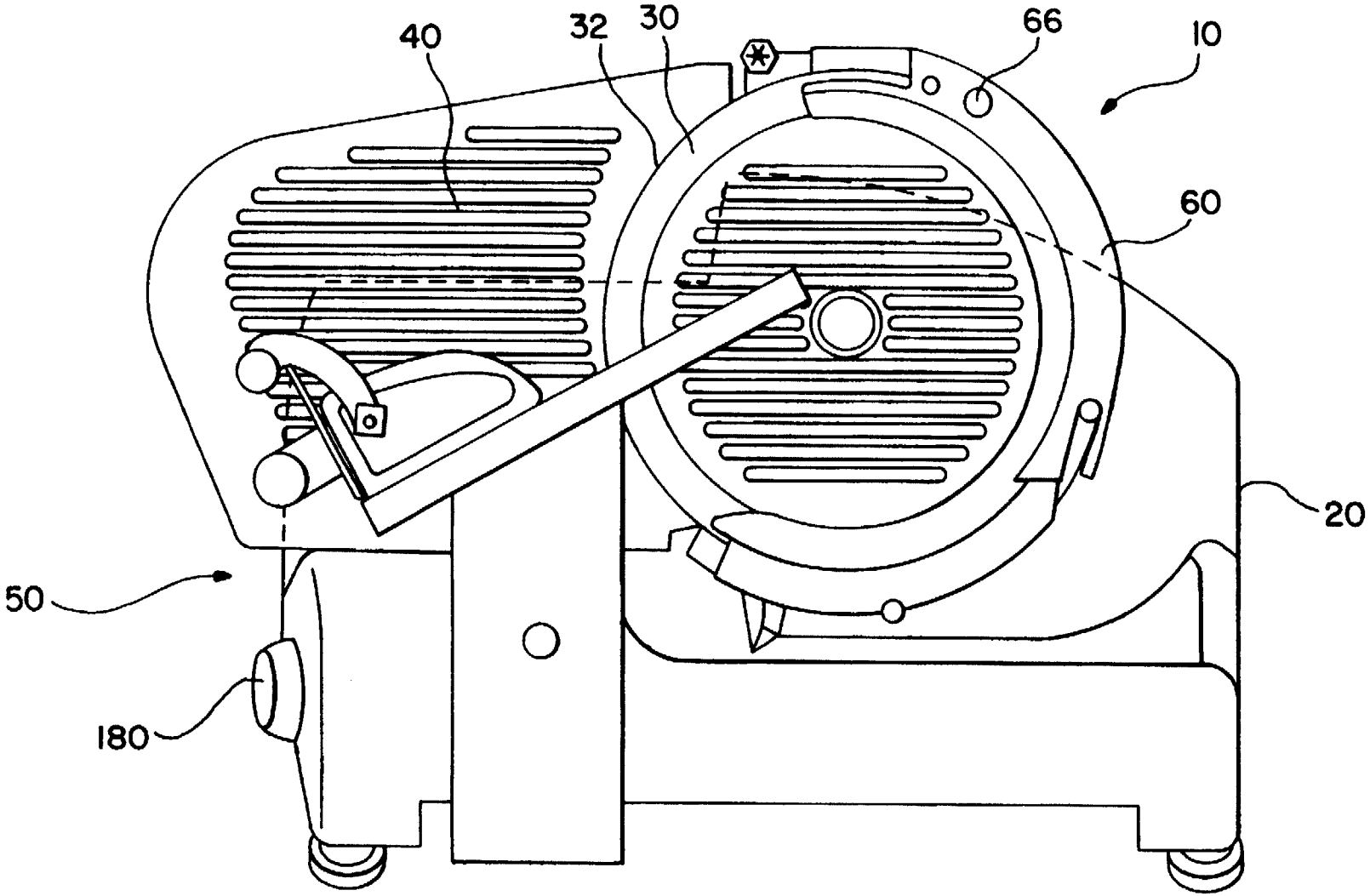
FIG. 1 is a perspective view of a food product slicer which employs the interlock mechanism of this invention.

As seen in FIG. 1, a food product slicer 10 includes a motor (not shown), a housing 20, a slicing blade 30, a gauge plate 40, a product support carriage 50, a cover plate 60 and an adjustment knob 180. Slicing blade 30 and gauge plate 40 are conventional and mounted on housing 20 of slicer 10. Slicer 10 conventionally includes a product support carriage 50 which is reciprocated either manually by the machine operator or driven by a motor in the case of an automatic slicer. The motor rotates slicing blade 30 by means of a fixed-axis shaft. Gauge plate 40 is moveable axially with respect to the plane of the blade 30 for determining slice thickness. The gauge plate 40 can also be located at the "closed" position at which it covers that portion of the periphery of the blade edge 32 which is usually exposed during a cutting operation.

Gauge plate 40 covers approximately one-third of peripheral edge 32 of slicing blade 30 when set at the closed position. The remainder of the circumference of peripheral edge 32 is covered by a ring guard. The ring guard acts to guard the user from coming into contact with that portion of blade 30 which is not used during the slicing operation. Cover plate 60 is removably mounted on slicer 10 over blade 30 and includes a handle 66 to facilitate its removal from the slicer 30.

Figure 2:
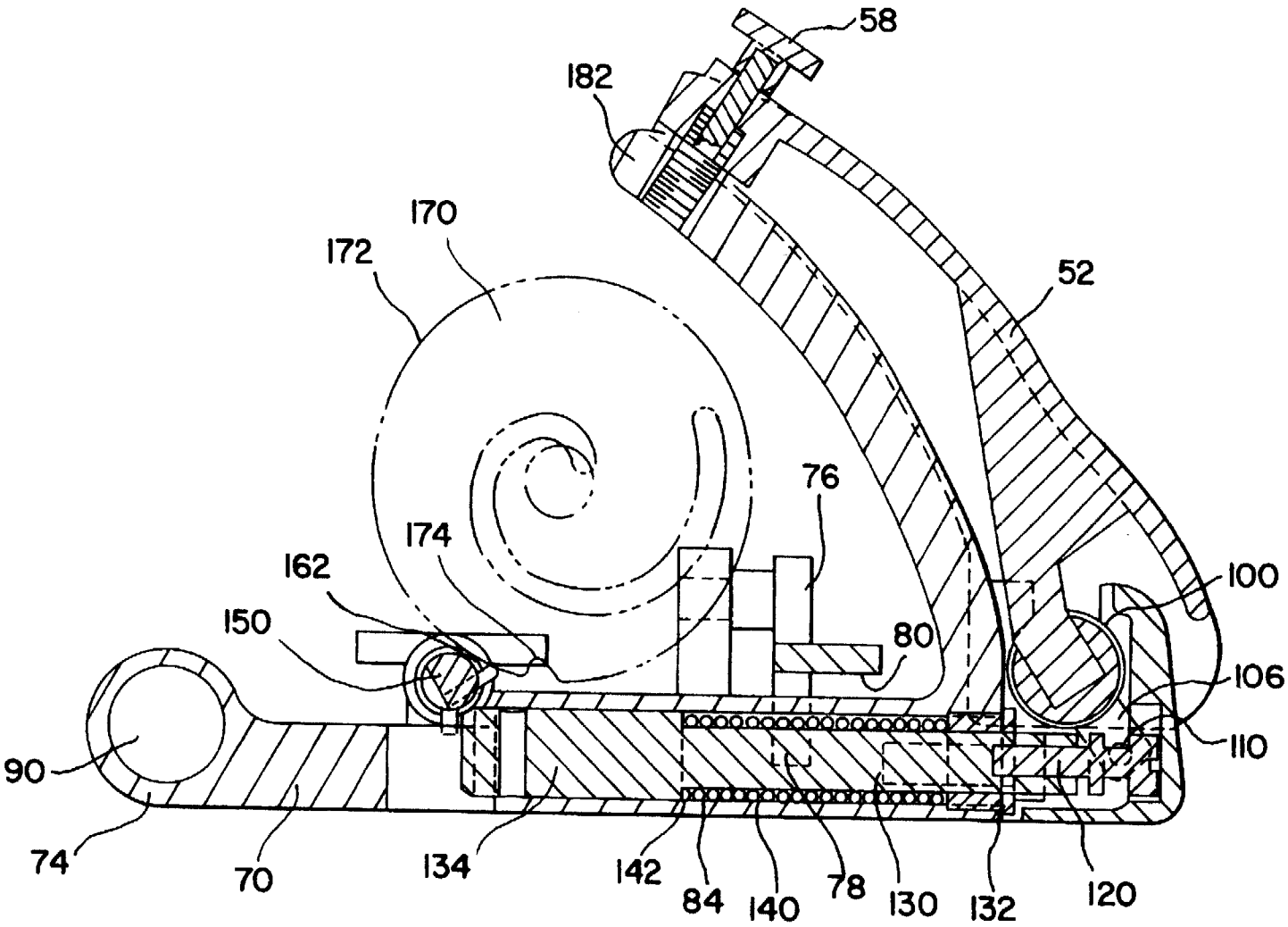
FIG. 2 is a cross-sectional view of the interlock mechanism of the food product slicer in the unlocked position.

As shown in FIGS. 1 and 2, carriage 50 consists of carriage arm 52 and carriage base 70 which reciprocates along track 80 and slide bar 90. Carriage arm 52 further includes foot 56 which is slidably received by mounting head 100. Carriage arm 52 may optionally include fastener 58 which is threaded into aperture 48 and used to lock carriage arm 52 into position on arm 182.

Base 70 of carriage 50 is mounted in the slicer on a circular slide bar 90 and a rectangular track 80. Base 70 includes a cylindrical channel 74 which receives bar 90. Base 70 further includes rollers 76 and 78 which ride on track 80. Thus, as carriage 50 reciprocates, bar 90 and track 80 carry carriage 50. Base 70 also includes a bracket 72 into which mounting head 100 is rotatably mounted. In its upper surface, bracket 72 has slot 82 which has a width slightly larger than that of foot 56 of carriage 50.

Figure 3:
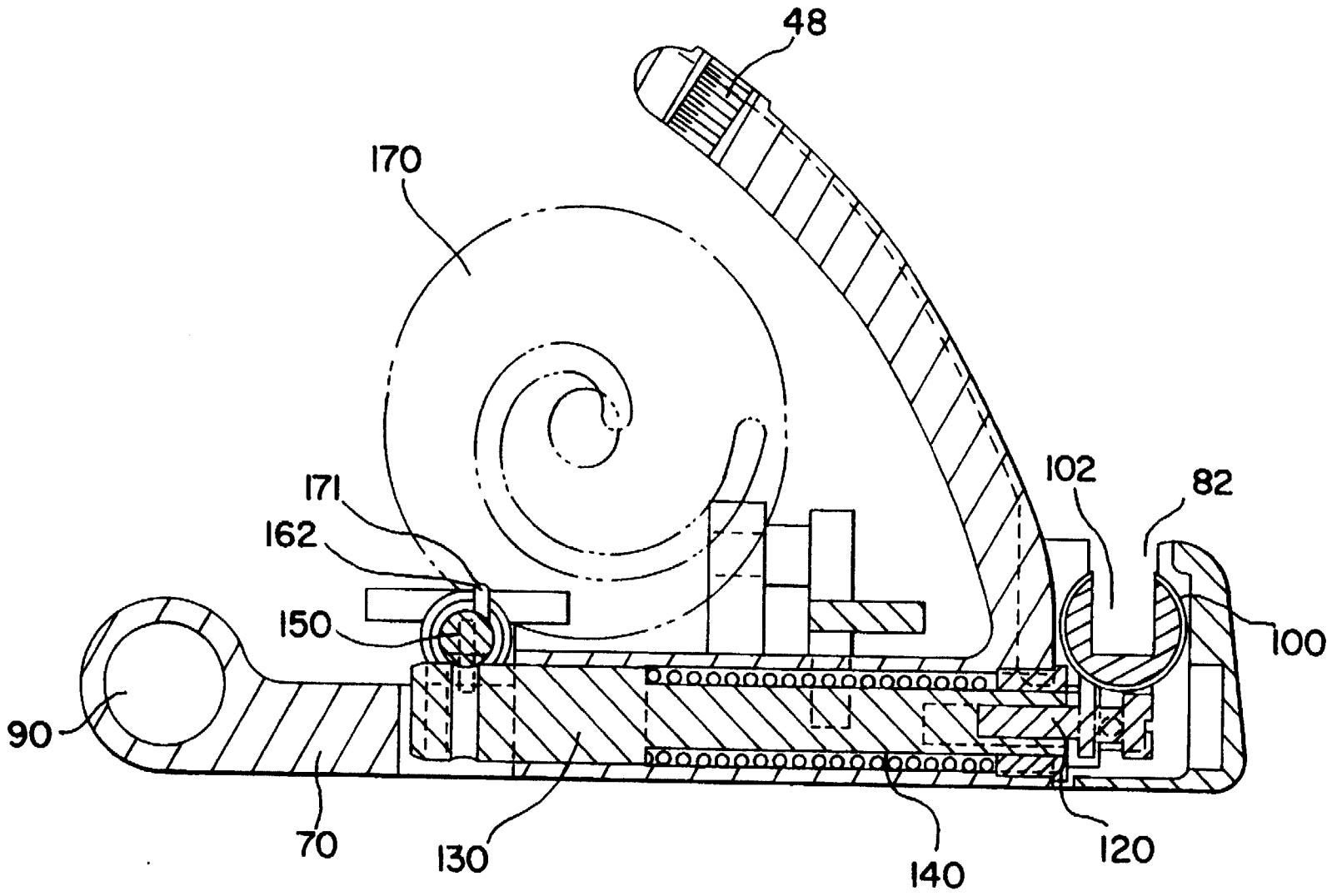
FIG. 3 is a cross-sectional view of the slicer with the interlock mechanism in the locked position.
Figure 4:
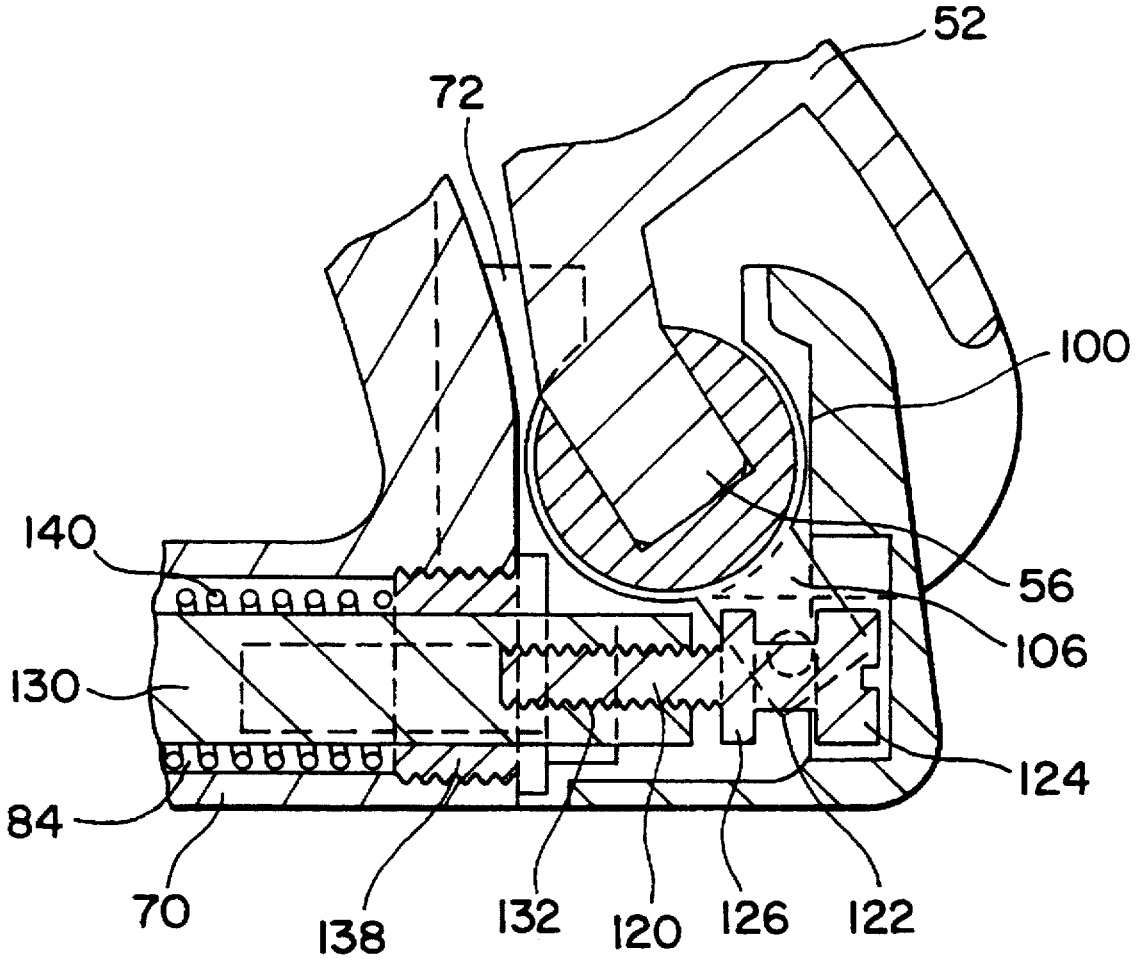
FIG. 4 is an expanded view of the mounting head portion of the interlock mechanism.
Figure 5:
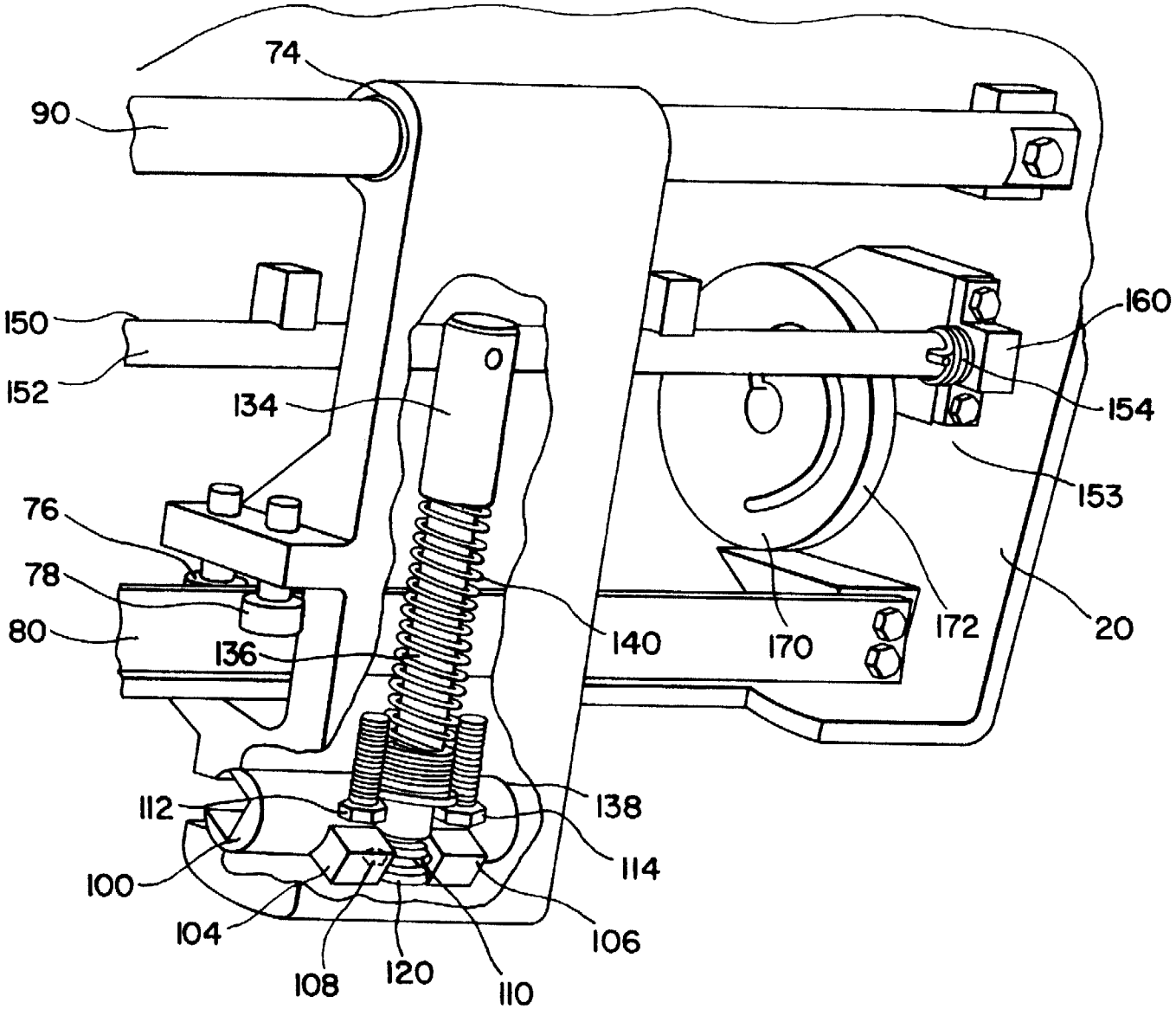
FIG. 5 is a bottom perspective view of the interlock mechanism of the food product slicer.

As shown in FIG. 4, mounting head 100 is rotatably mounted in bracket 72 in base 70. Mounting head 100 contains slot 102 which slidably receives foot 56 of carriage arm 52. As can be seen in FIG. 5, mounting head 100 further includes two shoulders 104 and 106, each of which has a pin, 108 and 110, respectively, mounted therein. Pins 108 and 110 act to couple mounting head 100 to screw 120 engaging neck 122 of screw 120. Screw 120 includes enlarged head 124, shoulder 126, and neck 122 located between head 124 and shoulder 126 as can best be seen in FIGS. 2 and 3. The coupling arrangement between pins 108 and 110 and screw 120 allows mounting head 100 to rotate without disconnecting pins 108 and 110 from neck 122 at some point during the rotational arc covered by pins 108 and 110 as they are moved by head 100. Below shoulder 126, screw 120 is threaded in aperture 132 in plunging element 130.

Plunging element 130 is slidably mounted in cylindrical channel 84 in base 70. Plunging element 130 has cylindrical head portion 134 and cylindrical body portion 136 which has a diameter smaller than that of head portion 134. Plunging element 130 further includes threaded aperture 132 located in the end of body portion 136 into which screw 120 is mounted. Threaded plug 138 has a hollow center, which body portion 136 slidably engages, and is threadedly mounted in the casting of reciprocating arm 70. Compression spring 140 encircles body portion 136, abuts shoulder 142 at one end and is retained on body portion 136 by plug 138 at its other end.

As shown in FIG. 5, interlock bar 150 has an irregular cross-section. Preferably, bar 150 is round and has a longitudinal flat 152 at one side or sector. Although described herein as preferably having a circular cross-section with a flat, interlock bar 150 may have any shaped cross-section which would cooperate with the mechanism of this invention. For example, a square or triangular cross-section may also be employed.

Interlock bar 150 extends over the path through which carriage 50 reciprocates and is rotatably mounted in bosses 160 and one not shown at each end of housing 20. Interlock bar 150 also has a spring mounting pin, 153 and one not shown, at each end near the mounting boss 160. At each end, spring pin 153 engages torsion spring 154 and one not shown which encircles bar 150. Torsion spring 154 is retained in an aperture (not shown) in mounting boss 160. The torsion springs bias bar 150 so that engaging pin 162 rides on the edge of cam plate 170. Engaging pin 162 is mounted on bar 150 such that its longitudinal axis is perpendicular to flat 152.

Cam plate 170 is journalled to adjustment knob 180. Adjustment knob 180 moves gauge plate 40 axially in relation to slicing blade 30 to determine the thickness of a resulting food slice by means of an adjustment mechanism, not shown. Movement of knob 180 in a first direction increases the thickness of the slice by causing gauge plate 40 to move away from slicing blade 30 and movement of adjustment knob 180 in a second direction decreases the thickness of the slice by causing gauge plate 40 to move toward slicing blade 30. Cam plate 170 further includes slot 174 located on its peripheral edge 172, which receives pin 162 on bar 150 thereby establing the interlock.

As a result of the structure and operation of the mounting mechanism for the carriage arm, as described next, when slicing machine 10 is in use, carriage arm 52 cannot be removed from machine 10. While machine 10 is in use, pin 162 rests on the outer periphery 172 of cam plate 170 as can be seen in FIG. 2. The positioning of pin 162 on cam plate 170 rotates bar 150 in a clockwise direction so that flat 152 is in a position which causes plunging element 130 to abut the rounded portion of interlock bar 150 if the user attempts to rock back carriage arm 52. When the user attempts to remove carriage arm 52, the interference between plunging element 130 and interlock bar 150 occurs because the rounded portion of interlock bar 150 does not afford plunging element 130 enough clearance to pass beneath bar 150. If plunging element 130 does not have sufficient clearance to pass below bar 150, then foot 56 of carriage arm 52 cannot be removed from slot 102 in mounting head 100 because slot 102 cannot align with slot 82 in carriage base 70. The alignment of slot 102 with slot 82 is not possible when plunging element 130 is retracted, thus removal of carriage arm 52 from mounting head 100 is prevented and the interlock is in a locked position.

To unlock the interlock and remove carriage 50 for cleaning, adjustment knob 180 is moved to the zero slice thickness setting which moves gauge plate 40 to the closed position. As shown in FIG. 3, at the zero setting, pin 162 on bar 150 engages slot 174 on cam plate 170. When pin 162 engages slot 174, bar 150 is in a position so that enough clearance is created by the rotation of flat 152 to allow plunging element 130 to pass beneath bar 150. To remove carriage arm 52 from machine 10, carriage arm 52 is rotated away from housing 20. As this is occurring, mounting head 100 rotates in bracket 72. As mounting head 100 rotates in bracket 72, pins 108 and 110 in shoulders 104 and 106 move screw 120 forward toward the inside of machine 10. When screw 120 is moved forward, it pushes body portion 136 of plunging element 130 toward the bar 150. Body portion 136 subsequently pushes head portion 134 beneath flat portion 152 of bar 150. This allows slot 102 in mounting head 100 to align with slot 82 in carriage base 70. To prevent mounting head 100 from over rotating and to ensure that slot 102 properly aligns with slot 82, reciprocating arm 70 includes two bolts, 112 and 114, which engage arms 104 and 106, respectively, of mounting head 100. When arms 104 and 106 contact bolts 112 and 114, slot 102 aligns with slot 82. Once slot 102 is aligned with slot 82, carriage arm 52 then can be lifted vertically removing foot 56 from slot 102 in mounting head 100. Carriage arm 52 can then be disconnected from carriage base 70 and the assembly can be cleaned.

As seen in FIG. 3, while carriage 52 is removed for cleaning, gauge plate 40 cannot be moved from the zero position to expose cutting blade 30. The extension of plunging element 130 below flat 152 on bar 150 prevents bar 150 from moving radially. If bar 150 cannot move radially, then pin 162 cannot dislodge from slot 174 on cam plate 170. Thus, if cam plate 170 cannot move, then adjustment knob 180 and, subsequently gauge plate 40, cannot be moved from the zero slice thickness position. Compression spring 140 biases plunging element 130 beneath flat 152 on bar 150. To prevent the interlock device from easily disengaging while carriage arm 52 is removed, compression spring 140 provides sufficient biasing force to maintain plunging element 130 under bar 150 until carriage arm 52 is replaced onto the slicer 10.

Once carriage arm 52 is replaced and plunging element 130 is retracted, gauge plate 40 can then be moved. Foot 56 must first be reinserted into slot 102 in head 100. As carriage arm 52 is rotated toward housing 20 of slicer 10, mounting head 100 rotates counterclockwise in bracket 72. As mounting head 100 rotates, plunging element 130 is removed from beneath bar 150 when pins 108 and 110 in shoulders 104 and 106 on head 100 pull screw 120 laterally away from bar 150. To remove plunging element 130 from beneath interlock bar 150, the user must apply sufficient force to overcome the biasing force of spring 140. Because of the force of spring 140, mounting head 100 and plunging element 130 can only be moved when carriage arm 52 has been replaced on the slicer 10. Once carriage arm 52 has been replaced, carriage arm 52 can be secured into position by threading knob 58 into aperture 48.

Once plunging element 130 is removed from beneath bar 150, cam plate 170 can then be rotated by adjustment knob 180 to dislodge pin 162 from slot 174 by overcoming the force placed on bar 150 by torsion springs 154 and one not shown. Once the force of the springs 154 and one not shown is overcome, pin 162 is disengaged from slot 174 in cam plate 170 and moved to ride on peripheral edge 172, as described above. Cam plate 170 and, subsequently, adjustment knob 180 can then be moved.

Having described the invention in detail, it will be apparent that numerous variations and modifications are possible without departing from the spirit and scope of the invention as defined by the following claims.

What is claimed is:

1. A food product slicer comprising:

a housing;

a circular slicing blade rotatably mounted in the housing;

a removable carriage arm, the carriage arm being mounted on the carriage and having a foot;

a food product carriage mounted for reciprocation on the housing;

a bracket on the carriage having a mounting head rotatably received therein, the mounting head and the bracket having slots therein which are alignable with one another such that when the slots are aligned, the foot of the carriage arm can be inserted into or removed from the mounting head; and an interlock engaged by the rotation of the mounting head in the bracket, the interlock comprising a plunging element, linked to the carriage arm, which reciprocates between a first, retracted position, in which the carriage arm is in a food slicing position, and a second, extended position, in which the carriage arm is in a cleaning position, the plunging element being reciprocated by pivoting the carriage arm;

an interlock bar mounted in the housing and extending over the path of displacement of the carriage, the interlock bar having an irregular cross section and being rotatable between a first position in which it blocks reciprocation of the plunging element thereby preventing the carriage arm from being pivoted to an extended position and a second position in which it does not block reciprocation of the plunging element allowing the carriage arm to be pivoted to the cleaning position; and a pin carried on the interlock bar, the pin cooperating with the adjustment mechanism such that when the gauge plate is in the open position, the interlock bar is in the first position and when the gauge plate is in the closed position, the interlock bar is in the second position.

2. A food product slicer comprising:

a housing a circular slicing blade rotatably mounted in the housing;

a gauge plate adjustable relative to the slicing blade for setting the thickness of a food product slice;

an adjustment mechanism for adjusting the gauge plate from a closed position to an open position;

a food product carriage mounted for reciprocation on the housing;

a removable carriage arm pivotally mounted on the carriage;

a plunging element, linked to the carriage arm, which reciprocates between a first retracted position, in which the carriage arm is in a food slicing position, and a second extended position, in which the carriage arm is in a cleaning position, the plunging element being reciprocated by pivoting the carriage arm;

an interlock bar mounted in the housing and extending over the path of displacement of the carriage, the interlock bar having an irregular cross-section and being rotatable between a first position in which it blocks reciprocation of the plunging element thereby preventing the carriage arm from being pivoted to an extended position and a second position in which it does not block reciprocation of the plunging element allowing the carriage arm to be pivoted to the cleaning position; and a pin carried on the interlock bar, the pin cooperating with the adjustment mechanism such that, when the gauge plate is in the open position, the interlock bar is in the first position and, when the gauge plate is in the closed position, the interlock bar is in the second position;

wherein the plunging element is linked to the carriage arm by a mounting head, the mounting head pivoting within a bracket in the carriage, and the carriage arm is only movable from the mounting head when the interlock bar is in the second position and the mounting head and the bracket are in alignment.

3. The food product slicer of claim 2 wherein the mounting head includes a slot therein for receiving a foot on the carriage arm, the bracket having an opening therein and cooperating with the mounting head such that the carriage arm can only be removed from the mounting head when the interlock bar is in the second unlocked position.

4. A food product slicer comprising:

a housing;

a circular slicing blade rotatably mounted in the housing;

a gauge plate adjustable relative to the slicing blade for setting the thickness of a food product slice;

an adjustment mechanism for adjusting the gauge plate from a closed position to an open position;

a food product carriage mounted for reciprocation on the housing;

a removable carriage arm, the carriage arm being mounted on the carraige and having a foot;

a bracket on the carriage having a mounting head rotatably received therein, the mounting head and the bracket having slots therein which are alignable with one another such that when the slots are aligned, the foot of the carriage arm can be inserted into or removed from the mounting head an interlock cooperating with the bracket and the gauge plate such that when the gauge plate is in the open position the slots are prevented from aligning, and when the gauge plate is in the closed position the carriage arm is pivotable to a cleaning position.

5. The food product slicer of claim 4 wherein at least one shoulder extends from the mounting head.

6. The food product slicer of claim 5 wherein the carriage further includes at least one bolt mounted thereon, the bolt engaging at least one of the shoulders when the mounting head is moved to align the slot in the mounting head with the slot in the bracket.

* * * * *

UNITED STATES PATENT AND TRADEMARK OFFICE

CERTIFICATE OF CORRECTION

PATENT NO. : 5,615,591

DATED : April 1, 1997

INVENTOR(S) : Richard P. Scherch et al.

It is certified that error appears in the above-indentified patent and that said Letters Patent is hereby corrected as shown below:

[75] Inventors "Danny J. Mitchell, Frankling, Ohio" should be --Danny J. Mitchell, Franklin, Ohio--.

Claim 4, col. 7, line 2, "carraige" should be --carriage--.

Signed and Sealed this

Fifth Day of August, 1997

Bruce Lehman

*Attest:*

BRUCE LEHMAN

*Attesting Officer*

*Commissioner of Patents and Trademarks*